US010724169B2

(12) United States Patent
Vian et al.

(10) Patent No.: US 10,724,169 B2
(45) Date of Patent: Jul. 28, 2020

(54) LAUNDRY TREATMENT APPARATUS AND METHOD FOR OPERATING A LAUNDRY TREATMENT APPARATUS

(71) Applicant: Electrolux Appliances Aktiebolag, Stockholm (SE)

(72) Inventors: Alessandro Vian, Meduna di Livenza (IT); Paolo Ros, Fiume Veneto (IT); Agnieszka Kustra, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 1054 days.

(21) Appl. No.: 14/909,186

(22) PCT Filed: Jul. 15, 2014

(86) PCT No.: PCT/EP2014/065160

§ 371 (c)(1),
(2) Date: Feb. 1, 2016

(87) PCT Pub. No.: WO2015/014608

PCT Pub. Date: Feb. 5, 2015

(65) Prior Publication Data

US 2016/0160429 A1 Jun. 9, 2016

(30) Foreign Application Priority Data

Aug. 1, 2013 (EP) ..... 13178974

(51) Int. Cl.
*D06F 58/30* (2020.01)
*D06F 39/04* (2006.01)
(Continued)

(52) U.S. Cl.
CPC ..... *D06F 58/30* (2020.02); *D06F 39/045* (2013.01); *D06F 2103/36* (2020.02); *D06F 2105/24* (2020.02)

(58) Field of Classification Search
CPC ..... D06F 58/28; D06F 39/045; D06F 2058/2864; D06F 58/30; D06F 2103/36; D06F 2105/24
See application file for complete search history.

(56) References Cited

U.S. PATENT DOCUMENTS

2011/0146102 A1 6/2011 Bellinetto et al.
2013/0047459 A1* 2/2013 Geer ..... F26B 25/22 34/467

FOREIGN PATENT DOCUMENTS

CN 102206916 A 10/2011
EP 1767687 A1 3/2007
(Continued)

OTHER PUBLICATIONS

International Search Report dated Sep. 19, 2014 in corresponding International Application No. PCT/EP2014/065160.
(Continued)

*Primary Examiner* — Jessica Yuen
(74) *Attorney, Agent, or Firm* — RatnerPrestia

(57) ABSTRACT

A laundry treatment apparatus, in particular a dryer or a washing machine having a dryer function, and a method for operating the apparatus are disclosed. The apparatus includes a laundry treatment chamber (18) for treating laundry using process air (A), a blower (8) for circulating the process air (A) within the laundry treatment chamber (18); and at least one temperature sensor (27, 28, 29). The method includes: detecting by said at least one temperature sensor (27, 28, 29) at least one temperature signal indicative of the ambient temperature of the laundry treatment apparatus, selecting a predetermined speed profile for operating the laundry treatment chamber (18) or the blower (8) in dependency of the at least one temperature signal detected by said at least one temperature sensor (27, 28, 29), and starting to operate the laundry treatment chamber (18) or the blower (8)
(Continued)

in a laundry drying cycle by applying or executing the selected predetermined speed profile to the laundry treatment chamber (18) or to the blower (8) during the drying cycle in dependency of the at least one detected temperature signal.

19 Claims, 3 Drawing Sheets

(51) Int. Cl.
*D06F 103/36* (2020.01)
*D06F 105/24* (2020.01)

(56) References Cited

FOREIGN PATENT DOCUMENTS

| | | | | |
|---|---|---|---|---|
| EP | 2392725 | A2 | | 12/2011 |
| GB | 2002891 | A | | 2/1979 |
| JP | 08243298 | A | * | 9/1996 |
| JP | 2009101206 | A | | 5/2009 |
| WO | 2012084474 | A1 | | 6/2012 |

OTHER PUBLICATIONS

Dec. 5, 2016 (EP)—Office Action Application No. 13178974.5.
Nov. 28, 2016 (CN)—Office Action Application No. 201480043198.

* cited by examiner

LAUNDRY TREATMENT APPARATUS AND METHOD FOR OPERATING A LAUNDRY TREATMENT APPARATUS

The invention relates to a laundry treatment apparatus and to a method for operating a laundry treatment apparatus.

In the present application, the laundry treatment apparatus can be a dryer or washing-drying machine, i.e. a washing machine having a drying function.

BACKGROUND

In a known dryer or washing-drying machine, as far as the drying cycle is concerned, it is known to use an electric heater to heat air for use in a laundry treatment chamber (e.g., a laundry drum), called process air hereinafter. The process air is circulated in the laundry treatment chamber by means of a process air blower or fan. The laundry treatment chamber and the process air blower are rotated by a motor. Moisture may be optionally removed from process air using an air-air heat exchanger, or the process air may be exhausted outside the machine.

In order to save energy consumption, it is also known to use a heat pump system in place of or besides the electric heater, for heating the process air during the drying cycle.

More specifically, the heat pump system comprises a first heat exchanger (evaporator) for heating a refrigerator fluid, a second heat exchanger (condenser) for cooling the refrigerant fluid, an expansion device and a refrigerant loop, in which the refrigerant fluid is circulated through the first and second heat exchangers and the expansion device. A compressor is provided which is adapted to operate for circulating the refrigerant fluid through the refrigerant loop.

Process air flow rate influences the efficiency and reliability of the electric heater or the heat pump system of the dryer or washing-drying machine.

With specific reference to a dryer or washing-drying machine using a heat pump system for heating the process air during the drying cycle, in particular working situations, temperatures of the heat pump system may rise too much, thus reaching the critical working range of the compressor. In such conditions, it is necessary to switch off the compressor for a determined time period in order to let its temperature to decrease down to the normal working range while the process air fan is still running. Then the compressor can be switched on again keeping the drying cycle going on properly.

Such a solution has the drawback that the drying cycle lengthens considerably due to compressor stop(s). A particularly critical working situation occurs at low process air flow rate and high temperature of the ambient or environment where the laundry treatment apparatus is installed. In such a condition, heat pump system temperatures are quite high from the very beginning of the drying cycle and therefore the compressor can reach its critical working range quite quickly and frequently.

SUMMARY OF SELECTED INVENTIVE ASPECTS

It is an object of the present invention to provide a method for operating a laundry treatment apparatus and a laundry treatment apparatus, which provide an improved laundry drying performance.

In a first aspect thereof, the invention relates to a method for operating a laundry treatment apparatus, wherein the apparatus comprises: a laundry treatment chamber for treating laundry using process air; a blower or fan for circulating the process air within the laundry treatment chamber; and at least one temperature sensor.

The method comprises detecting by the at least one temperature sensor at least one temperature signal indicative of the ambient temperature of the laundry treatment apparatus. For example, the at least one temperature signal may be a temperature detected in a inner volume within the apparatus cabinet, a refrigerant temperature detected at the exit of the second heat exchanger, and a temperature of electronic boards (e.g. power board, compressor control board).

The method further comprises: selecting a predetermined speed profile for operating the laundry treatment chamber and/or the process air blower in dependency of the at least one temperature signal detected by the at least one temperature sensor, and starting to operate the laundry treatment chamber and/or the process air blower in a laundry drying cycle by applying or executing the selected predetermined speed profile to the laundry treatment chamber and/or to the process air blower during the drying cycle in dependency of the at least one detected temperature signal.

The illustrative method allows the operation of the laundry treatment chamber and/or of the process air blower to adapt to the temperature of the ambient where the laundry treatment apparatus is installed, before the drying cycle is started. The speed adjustment of motor(s) driving the laundry treatment chamber and/or the process air blower as a function of detected ambient temperature improves agitation of laundry inside the treatment chamber and the process air flow rate, thereby contributing to regulate the heat transfer between the process air and the heating device (refrigerant condenser in a heat pump system or an electric heater) which is provided for heating the process air. In this way, a drying process with operation conditions optimized according to the starting conditions of the laundry treatment apparatus is implemented.

In a preferred embodiment, the laundry treatment apparatus is a dryer or washing-drying machine having a heat pump system comprising a first heat exchanger, a second heat exchanger, an expansion device, a refrigerant loop, and a compressor for circulating the refrigerant fluid through the refrigerant loop.

Preferably, the at least one ambient temperature sensor is a sensor arranged internal or external the apparatus cabinet. More preferably, in case of a laundry treatment apparatus having a heat pump system, the at least one ambient temperature signal may be a temperature signal detected by means of a temperature sensor arranged in the refrigerant loop, more preferably at the condenser outlet, outside the airflow circuit. As a further example, the at least one temperature signal may be a temperature of electronic boards (e.g. power board, compressor control board). In an embodiment, the temperature signal is a signal derived from two, three or more temperature sensors arranged at different locations within the laundry treatment apparatus cabinet. A mathematical function may be applied to two or more detected temperature signals to calculate or determinate the 'detected' temperature signal.

Preferably, the laundry treatment apparatus comprises a control unit for starting and controlling the laundry treatment chamber and/or the process air blower according to the speed profile as described above and below, i.e. the predetermined control profile is implemented or executed by the control unit.

Preferably, the selection of the predetermined speed profile comprises: comparing the detected temperature signal with a predetermined threshold temperature; applying a first or hot cycle speed profile to the laundry treatment chamber and/or to the process air blower, whether the detected temperature signal exceeds said predetermined threshold temperature; or applying a second or normal cycle speed profile to the laundry treatment chamber and/or to the process air blower whether the detected temperature signal is below said predetermined threshold temperature.

In a preferred embodiment, the first or hot cycle speed profile is a first or hot cycle speed profile of a plurality of first or hot cycle speed profiles and applying said first or hot cycle speed profile from said plurality of first or hot cycle speed profiles comprises: determining an offset of the detected temperature signal from the predetermined threshold temperature; and selecting the first or hot cycle speed profile from said plurality of first or hot cycle speed profiles based on the determined offset.

Preferably, applying the first or hot cycle speed profile to the laundry treatment chamber and/or to the process air blower comprises operating the laundry treatment chamber and/or to the process air blower at a first speed, whereas applying said second or normal cycle speed profile to the laundry treatment chamber and/or to the process air blower comprises operating the laundry treatment chamber and/or the process air blower at a second speed, wherein the second speed is lower than the first speed.

Preferably, the predetermined threshold temperature has a value which is the same for all the drying programs or cycles of the laundry treatment apparatus. More preferably, the predetermined threshold temperature has a value varying based on the selected drying program or cycle of the laundry treatment apparatus.

In an embodiment, speed profiles applied to the laundry treatment chamber and/or to the process air blower are constant during the entire drying cycle. In a further embodiment, speed profiles applied to the laundry treatment chamber and/or to the process air blower are variable during the entire drying cycle in function of one or more parameters indicating the status of a drying process or on a time basis.

Preferably, the laundry treatment apparatus comprises a control unit having an associated memory, wherein at least one, at least two or more than two speed profiles are stored in the memory for being selectively retrieved and executed by the control unit.

Preferably, detecting comprises detecting the at least one temperature signal before starting the drying cycle.

In a preferred embodiment, the method comprises: detecting a first temperature signal before a drying cycle is started; detecting a second temperature signal after a predetermined time from the start of the drying cycle; comparing the first and second temperature signal; and applying a first or hot cycle speed profile to the laundry treatment chamber and/or to the process air blower, whether the second temperature signal exceeds the first temperature signal; otherwise, applying a second or normal cycle speed profile to the laundry treatment chamber and/or to the process air blower.

Preferably, the method comprises: detecting at least two temperatures of at least two spaced apart positions in the cabinet of the laundry treatment apparatus to determine a temperature gradient between the at least two positions; comparing the temperature gradient with a predetermined threshold range; and applying a first or hot cycle speed profile to the laundry treatment chamber and/or to the process air blower, whether the determined temperature gradient is equal to or lower than the predetermined threshold range; otherwise, applying a second or normal cycle speed profile to the laundry treatment chamber and/or to the process air blower.

In a second aspect thereof, the invention relates to a laundry treatment apparatus comprising a laundry treatment chamber for treating laundry using process air, a blower for circulating the process air within the laundry treatment chamber, at least one temperature sensor, a control unit and at least one variable speed motor driving the laundry treatment chamber and/or the process air blower; wherein the at least one motor operates the laundry treatment chamber and/or the process air blower at different speed profiles under the control of the control unit; and wherein the control unit is adapted to implement a above mentioned method.

Any of the above described features and elements of the method for operating a treatment apparatus may be combined in any arbitrary combination and may be implemented in a laundry dryer or a washing machine having drying function as described above.

In the following description and in the accompanying drawings reference is made to a laundry treatment apparatus provided with a heat pump system and to a method for operating this apparatus by applying or executing the selected predetermined speed profile to the laundry treatment chamber and/or to the process air blower during the drying cycle in dependency of the at least one detected temperature signal. However it is understood that the same applies to a laundry treatment apparatus provided with a heater for heating drying process air and optionally with an air-air type heat exchanger for removing moisture from process air, instead of a heat pump system.

BRIEF DESCRIPTION OF THE DRAWINGS

Reference is made in detail to preferred embodiments of the invention, examples of which are illustrated in the accompanying drawings, wherein.

DETAILED DESCRIPTION OF EXAMPLE EMBODIMENTS

Figure 1:
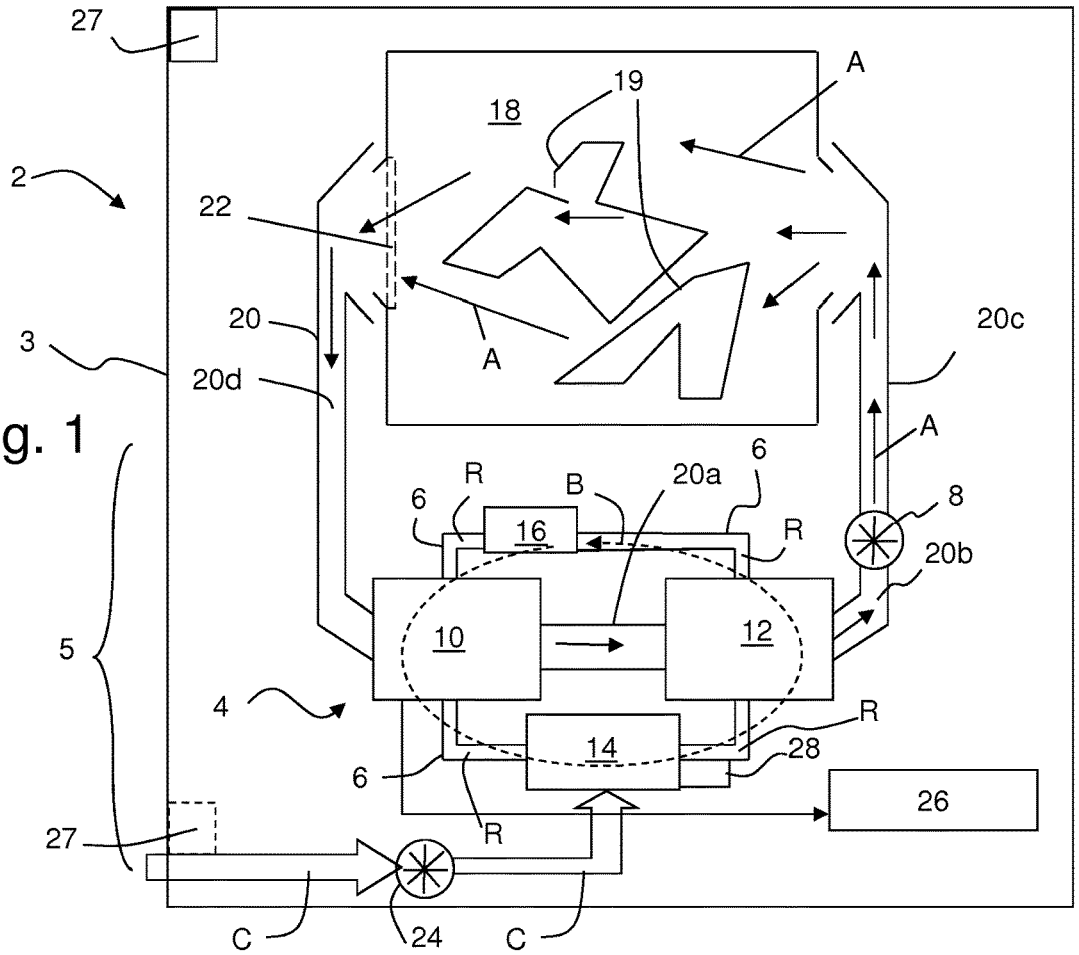
FIG. 1 shows a schematic view of a laundry treatment apparatus having a heat pump system.

FIG. 1 depicts a schematic representation of a laundry treatment apparatus 2 which, in this embodiment, is a heat pump tumble dryer.

The laundry treatment apparatus 2 has a cabinet or housing 3 comprising a laundry treatment chamber or drum 18 for treating laundry using a process air A and a process air blower or fan 8 for circulating the process air A within the drum 18. The laundry treatment chamber 18 and the process air blower 8 are both rotated by a motor 32. In another embodiment, there are provided two motors, one for rotating the laundry treatment chamber 18 and the other for rotating the process air blower 8. Preferably, the motor(s) is/are synchronous motor(s) or permanent magnet motor(s). Motor (s) is/are variable speed motor(s), preferably controlled by an inverter.

The cabinet 3 further comprises a heat pump system 4, including in a closed refrigerant loop 6 in this order of refrigerant flow B: a first heat exchanger 10 acting as evaporator for evaporating the refrigerant R and cooling process air A, a compressor 14, a second heat exchanger 12 acting as condenser for cooling the refrigerant R and heating the process air A, and an expansion device 16 from where the refrigerant R is returned to the first heat exchanger 10.

Together with the refrigerant pipes connecting the components of the heat pump system 4 in series, the heat pump system 4 forms a refrigerant loop 6 through which the refrigerant R in the heat pump system is circulated by the compressor 14 as indicated by arrow B. If the refrigerant R in the heat pump system 4 is operated in the transcritical or totally supercritical state, the first and second heat exchanger 10, 12 can act as gas heater and gas cooler, respectively.

The expansion device 16 is a controllable valve that operates under the control of a control unit 30 (FIG. 2) to adapt the flow resistance for the refrigerant R in dependency of operating states of the heat pump system 4. In an embodiment the expansion device 16 may be a fixed, non-controllable device like a capillary tube.

The process air flow within the treatment apparatus 2 is guided through a chamber 18 for receiving articles to be treated, e.g. a drum 18. The articles to be treated are textiles, laundry 19, clothes, shoes or the like. In the embodiments here these are preferably textiles, laundry or clothes.

The process air flow is indicated by arrows A in FIG. 1 and is driven by a process air blower or fan 8. The process air channel 20 guides the process air flow A outside the drum 18 and includes different sections, including the section forming the battery channel 20*a* in which the first and second heat exchangers 10, 12 are arranged. The process air exiting the second heat exchanger 12 flows into a rear channel 20*b* in which the process air blower 8 is arranged. The air conveyed by blower 8 is guided upward in a rising channel 20*c* to the backside of the drum 18. The air exiting the drum 18 through the drum outlet (which is the loading opening of the drum) is filtered by a fluff filter 22 arranged close to the drum outlet in or at the channel 20.

When the heat pump system 4 is operating, the first heat exchanger 10 transfers heat from process air A to the refrigerant R. By cooling the process air to lower temperatures, humidity from the process air condenses at the first heat exchanger 10, is collected there and drained to a condensate collector 26. The process air A which is cooled and dehumidified after passing the first heat exchanger 10 passes subsequently through the second heat exchanger 12 where heat is transferred from the refrigerant R to the process air A. The process air A is sucked from exchanger 12 by the blower 8 and is driven into the drum 18 where it heats up the laundry 19 and receives the humidity therefrom. The process air A exits the drum 18 and is guided in front channel 20*d* back to the first heat exchanger 10. The main components of the heat pump system 4 are arranged in a base section 5 or basement of the laundry treatment apparatus 2.

The laundry treatment apparatus 2 comprises a temperature sensor 27 designed to detect the ambient temperature.

The 'ambient' temperature is a measure of the temperature of the ambient or environment where the laundry treatment apparatus 2 is located. For example when the laundry treatment apparatus 2 is located indoor, the ambient temperature is indoor temperature or when the laundry treatment apparatus 2 is placed outdoor (e.g. in a garage or a veranda) the ambient temperature is outside temperature or close to outside temperature.

Sensor 27 may be placed internal or external to the cabinet 3, but is preferably internal to it and arranged at a position such that at least at specific conditions the ambient temperature can be detected.

As indicated in FIG. 1, sensor 27 may be placed in an upper region of laundry treatment apparatus 2, for example at or close to the input panel 38. This position is distant to the heat sources or heated components (where the process air flows) and measures a temperature close to the external temperature. Alternatively, sensor 27 is placed in the bottom of the cabinet 3, for example in the air path of the cooling air C sucked in by an optional cooling air blower 24 such that (at least after operating the blower 24 for a short time) the detected ambient temperature is directly related to the 'external' temperature.

The laundry treatment apparatus 2 further comprises a temperature sensor 28 for monitoring or detecting a temperature of the refrigerant R (or of a temperature dependent on the refrigerant temperature) at the compressor output to provide a temperature signal for the control unit 30.

Figure 2:
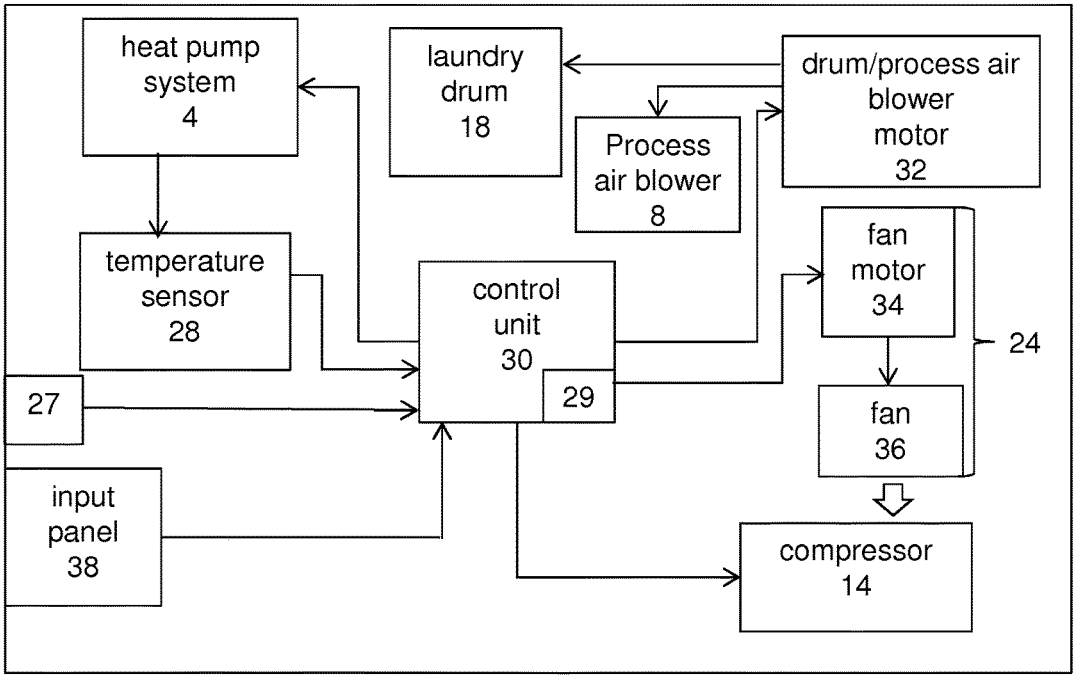
FIG. 2 shows a schematic block diagram of components of the apparatus of FIG. 1.

As shown in FIG. 2 a further temperature sensor 29 is provided to monitor or detect the temperature of an electronic board of the control unit 30, which provides a further temperature signal for the control unit 30.

Examples for locations for temperature sensors are: a refrigerant fluid outlet of the first or second heat exchanger 10, 12, an electronic board or inverter position of an electronic board or inverter controlling a component of the heat pump system 4, an electronic board or inverter position of an electronic board or inverter controlling the drum motor 32, a refrigerant fluid outlet position at the compressor 14, the compressor 14, the expansion device 16 or a position in the air flow A of the process air.

The optional cooling air blower 24 or fan unit is arranged close to the compressor 14 to remove heat from the compressor 14, i.e. from the heat pump system 4, during a drying operation. The cooling air flow C is taking heat from (the surface of) the compressor 14. The air blower 24 comprises a blower or fan 36 which is driven by a fan motor 34 controlled by the control unit 30 of the dryer 2.

As indicated in FIG. 1, the cooling air C is sucked in at the bottom of the cabinet 3 and conveyed towards the compressor 14 for compressor cooling. The cooling air (at least partially passed over the compressor) exits the cabinet 3 through openings at the cabinet bottom and/or rear wall. By transferring heat from the compressor 14, during operation of the heat pump system 4, the refrigerant is shifted to optimized thermodynamic conditions for the heat exchanges processes between the closed loops of the process air loop and the refrigerant loop 6. Alternatively no fan unit is provided.

FIG. 2 shows a schematically block diagram of components of the dryer of FIG. 1 illustrating the control of the dryer components.

The control unit 30 is adapted to control the operation of the components of the laundry treatment apparatus 2, i.e. the motor 32 driving the drum 18 and the process air blower 8, the compressor 14, the valve 16 (optionally) and the motor 34 driving the fan 36, according to the selected program.

Via an input panel 38 a user may select a drying program or cycle, e.g. FAST, ECONOMY, IRON-AID. Optionally further inputs may be made, e.g. residue humidity, laundry amount or laundry type. Further, the control unit 30 is adapted to control the drum 18 and the process air blower 8

(speed) such that during the drying cycle the operation conditions of the laundry treatment apparatus 2 can be optimized in view of energy consumption/drying duration/drying result/component lifetime.

Figure 3:
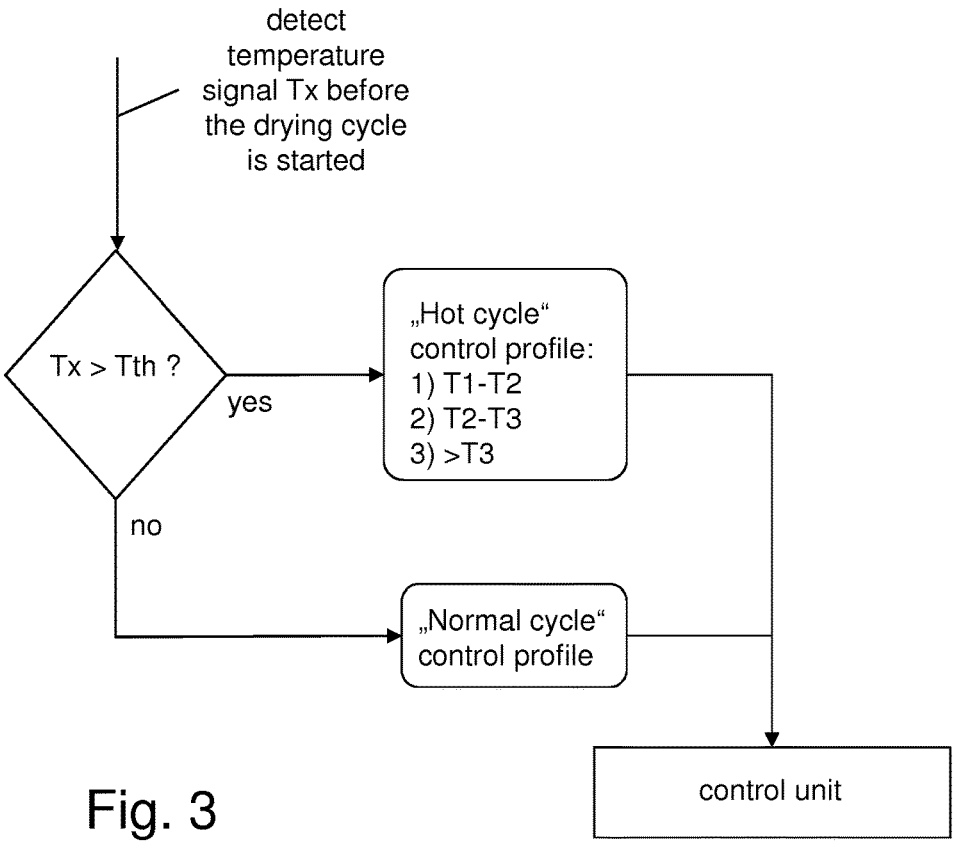
FIG. 3 shows a diagram schematically showing how laundry treatment chamber and/or process air blower control profiles are selected.

FIG. 3 shows a flow chart illustrating an exemplary method for operating a laundry treatment apparatus 2 as described above.

Before the drying cycle is started, a temperature signal Tx is detected, e.g. from temperature sensor 27 placed in the bottom of the cabinet 3.

Detection of the ambient temperature is performed when the temperature sensor 27 is considered to be in thermal equilibrium with the ambient surrounding the laundry treatment apparatus. Therefore, the ambient temperature detection is performed in a period when the apparatus is at rest, for example, in an interval between two drying processes which is, normally, at least one or more hours. The ambient temperature detection may also be performed in the very first instants of time when the laundry treatment apparatus has been switched ON, and/or when a drying program has been started but a drying effect on laundry has not yet substantially been carried out, i.e. before a drying cycle is started. More particularly, the ambient temperature detection may be performed up to few seconds after the drum and the process air blower start rotating and the process air heating device is not yet active or it has been just activated.

The detected temperature signal Tx is compared with a predetermined threshold temperature $T_{threshold}$. Preferably, the predetermined threshold temperature $T_{threshold}$ has a value, e.g. 30° C., which is the same for all the drying programs of the laundry treatment apparatus 2. In a preferred embodiment, the threshold temperature $T_{threshold}$ has a value varying based on the drying program or cycle of the laundry treatment apparatus 2 selected by the user. For example, a threshold temperature $T_{threshold}$ of 30° C. can be chosen for COTTON drying program or cycle, a threshold temperature $T_{threshold}$ of 27° C. can be chosen for SYNTHETIC drying program or cycle, and so on.

If the detected temperature signal Tx is above the above defined predetermined threshold temperature $T_{threshold}$, the laundry treatment apparatus 2 is regarded to be in a 'hot' state or condition and a corresponding control profile ('hot cycle') is applied to the drum 18 and/or to the process air blower 8.

As an example, if the detected temperature signal Tx is above the predetermined threshold temperature $T_{threshold}$ defined above, the motor 32 driving the drum 18 and the process air blower 8, in case a single driving motor 32 is provided, or the motor driving the drum 18 and/or the motor driving the process air blower 8, in case two driving motors, one for driving the drum 18 and the other for driving the process air blower 8, are provided, is/are operated at a speed of 2700 rpm.

If the detected temperature signal Tx is below the predetermined threshold temperature $T_{threshold}$ the laundry treatment apparatus 2 is regarded to be in a 'normal' state or condition, i.e. a corresponding control profile ('normal cycle') is applied to the drum 18 and/or to the process air blower 8.

As an example, if the detected temperature signal Tx is below the above defined threshold temperature $T_{threshold}$, the motor 32 driving the drum 18 and the process air blower 8, in case a single driving motor 32 is provided, or the motor driving the drum 18 and/or the motor driving the process air blower 8, in case two driving motors, one for driving the drum 18 and the other for driving the process air blower 8 are provided, is/are operated at a speed of 2400 rpm.

In a preferred embodiment, depending on the level of the detected temperature signal, a corresponding predetermined control profile ('hot cycle') is selected and applied to the drum 18 and/or the process air blower 8 via the control unit 30. The respective control profiles may be stored in a memory of the control unit 30 and retrieved from such memory for being applied to the motor(s) driving the drum 18 and/or the process air blower as described below.

More specifically, in the control unit memory may be provided one, two, three (as depicted in FIG. 3) or more predefined control profiles for the 'hot cycle', which for example are defined for specific temperature ranges. In a further embodiment, temperature ranges and associated predetermined control profiles may also be provided for the 'normal cycle'.

Returning to FIG. 3, as an example, the detection of 'hot cycle' provides for the temperature ranges (all above 30° C.) T1-T2 hot profile 1), T2-T3 hot profile 2), and above T3 hot profile 3).

As described above, a predetermined speed or control profile for operating the drum 18 and/or the process air blower 8 is selected in dependency of a temperature signal indicative of the ambient temperature of the laundry treatment apparatus 2 before the laundry starts to be dried. For example, after the selection of the predetermined control profile, the drum 18 and/or the process air blower 8 are/is operated for the length of the drying cycle without being further adapted to a temperature indicated by the temperature signal Tx.

Figure 4:
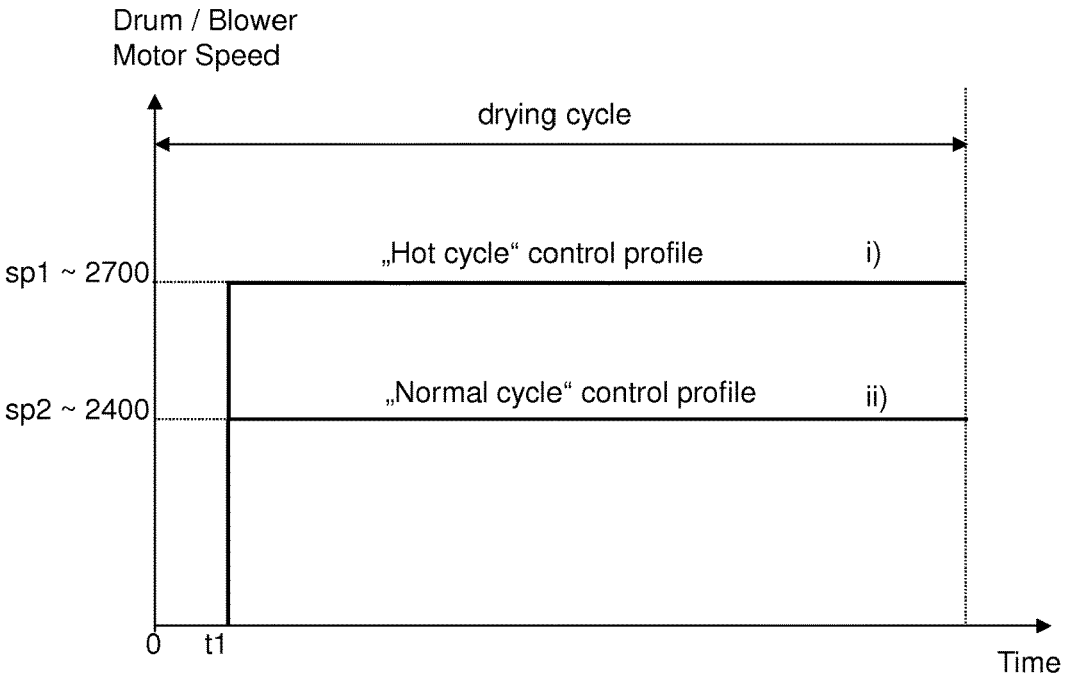
FIG. 4 shows a diagram schematically illustrating two exemplary laundry treatment chamber and/or process air blower control profiles.

FIG. 4 shows exemplary schematic control profiles i), ii) for the above described 'hot' state i) and 'normal' state ii) of the laundry treatment apparatus 2.

When the detected temperature signal Tx, indicative of the ambient where the laundry treatment apparatus is installed, is above the predetermined threshold temperature $T_{threshold}$, a predetermined 'hot cycle' control profile i) is selected before the drying cycle is started (time t1) and the motor of the drum 18 and/or of the process air blower 8 is operated in order to rotate the drum 18 and/or the process air blower 8 at a first speed sp1, for example about 2700 rpm, for the length of the drying cycle.

When the detected temperature signal Tx, indicative of the ambient where the laundry treatment apparatus is placed, is below the predetermined threshold temperature $T_{threshold}$, a predetermined 'normal cycle' control profile ii) is selected before the drying cycle is started (time t1) and the motor of the drum 18 and/or of the process air blower 8 is operated in order to rotate the drum 18 and/or the process air blower 8 at a second speed sp2 lower than the first rotation speed, for example about 2400 rpm, for the length of the drying cycle.

In a preferred embodiment, the speed profiles, instead of being constant during the whole drying cycle—as shown in FIG. 4—can be variable in function of parameters indicating the status of a drying process, such as the residual humidity in the laundry, the laundry weight, the pressure acting on the refrigerant R of the heat pump system 4, the temperature of the refrigerant R, and the like. It is also possible to make the speed profiles variable on a drying cycle time-frame basis, so as to have different speed in different time ranges of the same laundry drying cycle.

Figure 5A:
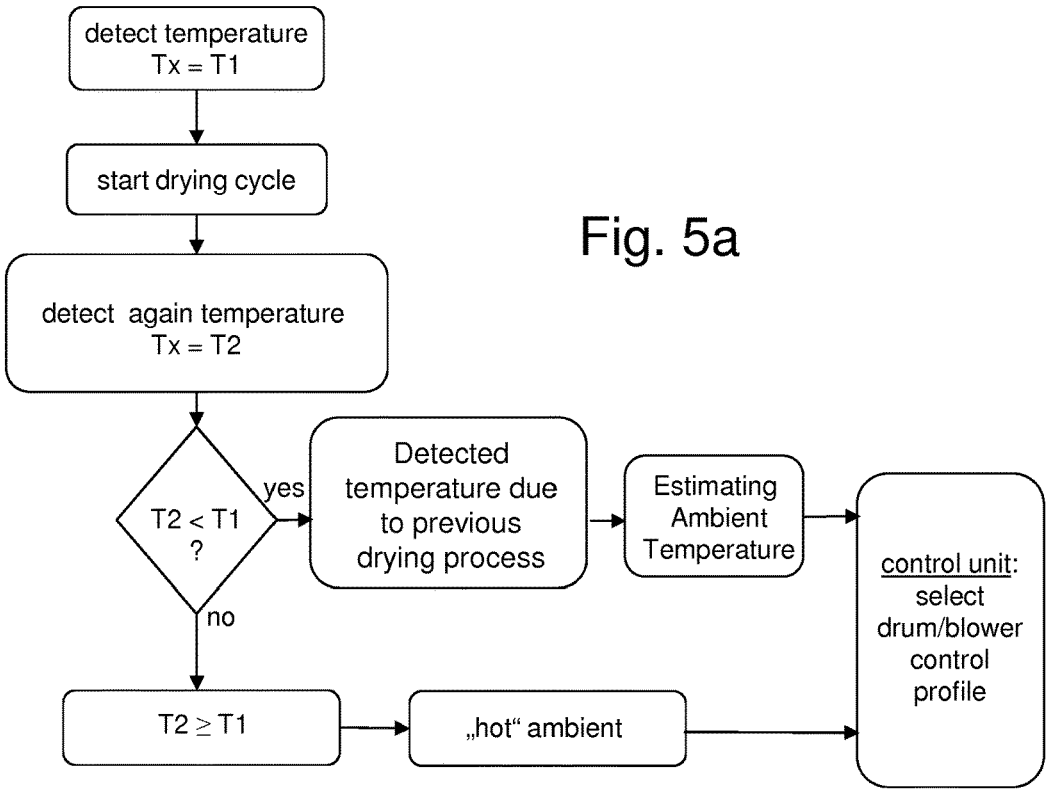
FIGS. 5*a-b* show flow charts illustrating how to evaluate whether a high detected temperature signal is due to ambient conditions or to what the laundry treatment apparatus has performed before the temperature detection.
Figure 5B:
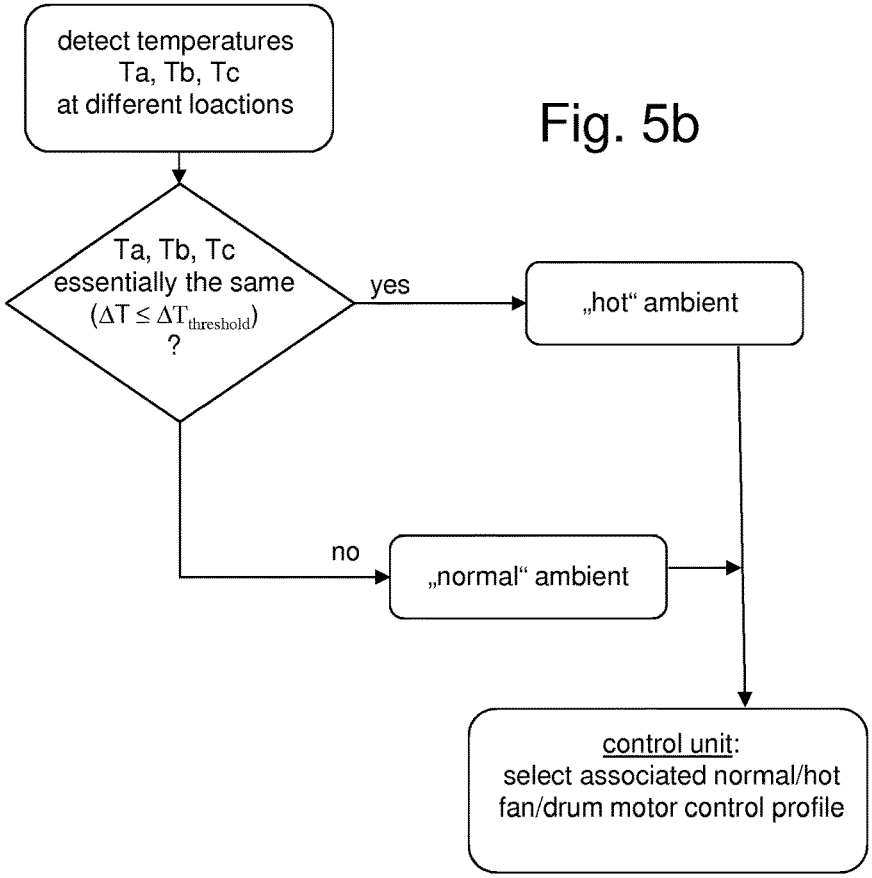

FIGS. 5*a-b* show flow charts of two different embodiments for evaluating whether a high detected temperature Tx (for example a temperature detected above 30° C.) is due to ambient conditions or is due to operating conditions of the laundry treatment apparatus 2 which were applied before the current temperature detection and resulted in the detection of the high temperature (e.g. starting a drying program immediately or shortly after a previous drying process).

As shown in FIG. 5*a*, an initial (high) temperature of Tx is T1 (at time t0) which is measured or detected just when the laundry treatment apparatus 2 is switched on or a drying program is selected. The temperature signal Tx may be measured through a temperature sensor installed in the laundry treatment apparatus 2, for example the sensor 27 placed internal or external to the cabinet 3, wherein any temperature sensor placed at other places of the apparatus 2 could be used for the same purpose. Another example would be one or more temperature sensors mounted on electronic boards, e.g. power board and a compressor control board.

Subsequently, the drying cycle is started, which means, in case a single motor 32 is provided, that the motor 32 rotates the drum 18 and the connected process air blower or fan 8 for circulating air A or, in case two motors are provided, one for the drum 18 and the other for the process air blower 8, that a motor (not shown in figures) rotates the drum 18 and another motor (not shown in Figures) rotates the process air blower 8.

After a predetermined time from the start of the drying cycle (e.g. 1 min) the temperature measurement is repeated to obtain a second temperature signal Tx=T2 (at time point t1>t0).

Then the two temperatures T1, T2 are compared. When the second temperature signal T2 is lower than the first (high) temperature signal T1, then the laundry treatment apparatus 2 is located in an ambient that is colder than the detected temperatures T1, T2. For example, the high temperature signal T1 results from a previous drying operation of the laundry treatment apparatus 2, but not from a generally high temperature of the ambient where the laundry treatment apparatus 2 is located. The actual ambient temperature may be estimated from detected temperatures T1, T2 and/or temperature difference T1-T2 and time elapsed between two subsequent temperature measurements by an appropriate algorithm.

The control unit 30 selects the control profile to be carried out based on the ambient temperature estimated by such an algorithm. Preferably, the control profile selection is performed among a plurality of predetermined control profiles.

When the second temperature signal T2 is the same of or higher than the first temperature signal T1, than the laundry treatment apparatus 2 is located in a high temperature ambient or in an ambient which does not allow sufficient removal of heat from the laundry treatment apparatus 2, e.g. the laundry treatment apparatus 2 is located is a small compartment or room. The control unit 30 selects control profiles based on detected temperature T1 or T2.

As shown in FIG. 5*b* three temperature sensors are available to detect three temperature signals Ta, Tb, Tc (at the same time) at three different positions in the laundry treatment apparatus. For example, temperature sensor 27 at the upper or lower region of the cabinet 3, temperature sensor 28 at the refrigerant circuit, and a temperature sensor 29 on the control board of the laundry treatment apparatus 2.

The detected temperature signals Ta, Tb, Tc are compared to determine whether they are essentially the same, i.e. whether the temperature values vary within a predetermined range $\Delta T \leq \Delta T_{threshold}$.

If the detected (high) temperature signals are essentially the same, the high temperature is due to the high ambient temperature condition. If one or more of the temperature sensors detects a completely different temperature, i.e. $\Delta T > \Delta T_{threshold}$ then the initial high temperature probably results from a previous drying cycle and the ambient temperature is normal.

The control unit 30 selects the appropriate predetermined control profile (normal cycle control profile(s) or normal cycle control profile(s)). The temperature difference ΔT may be a complex or simple function of the temperature signals Ta, Tb, Tc (ΔT=f(Ta, Tb, Tc)) or only a function of two of such temperature signals.

Conclusively, it can be stated that the present invention allows to provide a laundry treatment apparatus, specifically a dryer or a washing/drying machine, and a method for operating the same, which are suitable for improving the drying performance.

Although preferred embodiments have been shown and described, it would be appreciated by those skilled in the art that changes can be made in these embodiments without departing from the principles and spirit of the invention, the scope of which is defined in the claims and their equivalents.

The invention claimed is:

1. A method for operating a laundry treatment apparatus, wherein the apparatus comprises: a laundry treatment chamber for treating laundry using process air (A); a blower for circulating the process air (A) within the laundry treatment chamber; and at least one temperature sensor, the method comprising:

detecting by said temperature sensor a first temperature signal indicative of a temperature of the ambient where the laundry treatment apparatus is located before starting the drying cycle;

selecting a predetermined speed profile for operating the laundry treatment chamber and/or the process air blower in dependency of the first temperature signal detected by said at least one temperature sensor; and starting to operate the laundry treatment chamber and/or the process air blower in a laundry drying cycle by applying or executing the selected predetermined speed profile to the laundry treatment chamber and/or to the process air blower during the drying cycle in dependency of the first detected temperature signal.

2. The method according to claim 1, wherein the selection of the predetermined speed profile comprises:

comparing the first detected temperature signal with a predetermined threshold temperature ($T_{threshold}$); and applying a first or hot cycle speed profile to the laundry treatment chamber and/or to the process air blower when the first detected temperature signal exceeds said predetermined threshold temperature ($T_{threshold}$); or applying a second or normal cycle speed profile to the laundry treatment chamber and/or to the process air blower when the first detected temperature signal is below said predetermined threshold temperature ($T_{threshold}$).

3. The method according to claim 2, wherein said first or hot cycle speed profile is a first or hot cycle speed profile of a plurality of first or hot cycle speed profiles and applying said first or hot cycle speed profile from said plurality of first or hot cycle speed profiles comprises:

determining an offset of the first detected temperature signal from the predetermined threshold temperature ($T_{threshold}$); and selecting the first or hot cycle speed profile from said plurality of first or hot cycle speed profiles based on the determined offset.

4. The method according to claim 2, wherein applying said first or hot cycle speed profile to the laundry treatment chamber and/or to the process air blower comprises operating the laundry treatment chamber and/or to the process air blower at a first speed (sp1), whereas applying said second or normal cycle speed profile to the laundry treatment chamber and/or to the process air blower comprises operating the laundry treatment chamber and/or the process air blower at a second speed (sp2), wherein said second speed (sp2) is lower than the first speed (sp1).

5. The method according to claim 2, wherein said predetermined threshold temperature ($T_{threshold}$) has a value which is the same for all the drying programs or cycles of the laundry treatment apparatus.

6. The method according to claim 2, wherein said predetermined threshold temperature ($T_{threshold}$) has a value varying based on the selected drying program or cycle of the laundry treatment apparatus.

7. The method according to claim 2, wherein said speed profiles applied to the laundry treatment chamber and/or to the process air blower are constant during the entire drying cycle.

8. The method according to claim 2, wherein said speed profiles applied to the laundry treatment chamber and/or to the process air blower are variable during the entire drying cycle with respect to a function of one or more parameters indicating the status of a drying process or on a time basis.

9. The method according to claim 2, wherein the laundry treatment apparatus comprises a control unit having an associated memory, wherein at least two speed profiles are stored in the memory for being selectively retrieved and executed by the control unit.

10. The method according to claim 2, wherein the method comprises:

detecting the first temperature signal before a drying cycle is started, detecting a second temperature signal indicative of a temperature of the ambient where the laundry treatment apparatus is located after a predetermined time from the start of the drying cycle, comparing the first and second temperature signal, and applying a first or hot cycle speed profile to the laundry treatment chamber and/or to the process air blower, when the second temperature signal exceeds the first temperature signal, otherwise, applying a second or normal cycle speed profile to the laundry treatment chamber and/or to the process air blower.

11. The method according to claim 2, wherein the method comprises:

detecting at least two temperatures (Ta, Tb, Tc) of at least two spaced apart positions in the cabinet of the laundry treatment apparatus to determine a temperature gradient (ΔT) between the at least two positions, comparing the temperature gradient (ΔT) with a predetermined threshold range (ΔTthreshold); and applying a first or hot cycle speed profile to the laundry treatment chamber and/or to the process air blower, when the determined temperature gradient (ΔT) is equal to or lower than the predetermined threshold range (ΔTthreshold);

otherwise, applying a second or normal cycle speed profile to the laundry treatment chamber and/or to the process air blower.

12. The method according to claim 1, wherein said speed profiles applied to the laundry treatment chamber and/or to the process air blower are constant during the entire drying cycle.

13. The method according to claim 1, wherein said speed profiles applied to the laundry treatment chamber and/or to the process air blower are variable during the entire drying cycle with respect to a function of one or more parameters indicating the status of a drying process or on a time basis.

14. The method according to claim 1, wherein the laundry treatment apparatus comprises a control unit having an associated memory, wherein at least two speed profiles are stored in the memory for being selectively retrieved and executed by the control unit.

15. The method according to claim 1, wherein the method comprises:

detecting the first temperature signal before a drying cycle is started, detecting a second temperature signal indicative of a temperature of the ambient where the laundry treatment apparatus is located after a predetermined time from the start of the drying cycle, comparing the first temperature signal and the second temperature signal, and applying a first or hot cycle speed profile to the laundry treatment chamber and/or to the process air blower, when the second temperature signal exceeds the first temperature signal, otherwise, applying a second or normal cycle speed profile to the laundry treatment chamber and/or to the process air blower.

16. The method according to claim 1, wherein the method comprises:

detecting at least two temperatures (Ta, Tb, Tc) of at least two spaced apart positions in the cabinet of the laundry treatment apparatus to determine a temperature gradient (ΔT) between the at least two positions, comparing the temperature gradient (ΔT) with a predetermined threshold range (A $T_{threshold}$); and applying a first or hot cycle speed profile to the laundry treatment chamber and/or to the process air blower, when the determined temperature gradient (ΔT) is equal to or lower than the predetermined threshold range (A $T_{threshold}$);

otherwise, applying a second or normal cycle speed profile to the laundry treatment chamber and/or to the process air blower.

17. A laundry treatment apparatus, wherein the apparatus comprises a laundry treatment chamber for treating laundry using process air (A), a blower for circulating the process air (A) within the laundry treatment chamber, at least one temperature sensor, a control unit and at least one variable speed motor driving the laundry treatment chamber and/or the process air blower;

wherein the at least one motor operates the laundry treatment chamber and/or the process air blower at different speed profiles under the control of the control unit; and wherein the control unit is adapted to implement a method according to claim 1.

18. The laundry treatment apparatus according to claim 17, wherein the laundry treatment apparatus is a dryer or washing-drying machine comprising a heat pump system including:

a first heat exchanger for cooling a refrigerant fluid (R);

a second heat exchanger for heating the refrigerant fluid (R);

an expansion device, a refrigerant loop, in which the refrigerant fluid is circulated through the first and second heat exchangers and the expansion device; and a compressor for circulating the refrigerant fluid (R) through the refrigerant loop.

19. The laundry treatment apparatus according to claim 17, wherein the laundry treatment chamber and/or the process air blower are/is rotated by a motor, said motor being a synchronous motor.

* * * * *